United States Patent [19]

Say et al.

[11] 4,160,187

[45] Jul. 3, 1979

[54] POST-DEFLECTION ACCELERATION CRT SYSTEM

[75] Inventors: Donald L. Say, Waterloo; Harry E. Smithgall; Kenneth Speigel, both of Seneca Falls, all of N.Y.

[73] Assignee: GTE Sylvania Incorporated, Stamford, Conn.

[21] Appl. No.: 725,793

[22] Filed: Sep. 23, 1976

Related U.S. Application Data

[63] Continuation of Ser. No. 629,143, Nov. 5, 1975, which is a continuation of Ser. No. 504,999, Sep. 11, 1974, abandoned.

[51] Int. Cl.[2] ..... H01J 29/80; H01J 39/20

[52] U.S. Cl. ..... 313/408; 313/470; 315/376

[58] Field of Search ..... 313/408, 415, 461, 466

[56] References Cited

U.S. PATENT DOCUMENTS

| | | | |
|---|---|---|---|
| 2,303,563 | 12/1942 | Law | 313/466 |
| 2,665,220 | 1/1954 | De Gier | 313/466 X |
| 2,829,265 | 4/1958 | Harper | 313/466 X |
| 2,879,444 | 3/1959 | Nunan | 313/466 X |
| 3,278,326 | 10/1966 | McGee | 313/466 X |
| 3,340,421 | 9/1967 | Watanabe et al. | 313/466 X |
| 3,475,639 | 10/1969 | Driffort et al. | 313/106 |
| 3,586,900 | 6/1971 | Seki et al. | 313/408 X |
| 3,911,165 | 10/1975 | Kanai et al. | 313/466 X |

*Primary Examiner*—Robert Segal

*Attorney, Agent, or Firm*—Thomas H. Buffton

[57] ABSTRACT

Improvement is provided in a color cathode ray tube of the post-deflection acceleration type, in the form of an operational system including related tube geometry. An electron barrier, consisting of a metallic film having a defined voltage penetration threshold, is adheringly disposed on the surface of the screen. The potential on the screen is in the order of substantially 20 to 40 kilovolts while the potential of the related color-selection electrode is more than substantially 72 percent and less than 85 percent of the screen potential thereby effecting a definitive voltage differential ($\Delta V$) therebetween that is substantially equal to or less than the voltage penetration threshold of the metallic film. The improvement in the system provides enhanced contrast and color purity in the screen display and minimizes background luminescence of the screen resultant from spurious impingement of secondary electrons generated in the tube.

3 Claims, 2 Drawing Figures

POST-DEFLECTION ACCELERATION CRT SYSTEM

CROSS REFERENCE TO RELATED APPLICATIONS

This application is a continuation of Ser. No. 629,143, filed Nov. 5, 1975, which was a continuation of Ser. No. 504,999, filed Sept. 11, 1974, now abandoned. The present continuation application incorporates by reference the disclosure set forth in the prior applications which were designed to the assignee of the present application.

BACKGROUND OF THE INVENTION

This invention relates to cathode ray tubes for producing color imagery and more particularly to an improved system for controlling secondary electrons and improving the color imagery in a color cathode ray tube of the post-deflection acceleration type.

Color cathode ray tubes of the post-deflection type conventionally employ at least one electrode member oriented between the electron gun assembly and the spatially related cathodoluminescent screen. In its simplest form, a color tube of this type is structured to have a color-selection electrode that is spatially positioned relative to the patterned screen. Usually, the post-deflection type of tube construction permits the use of larger openings or apertures in the color-selection electrode than those normally employed in the mask of the conventional shadow mask type of tube. As a result, a screen display of increased brightness is possible in a post-deflection type of tube, but unfortunately problems are also evidenced.

In post-deflection tubes, the color selection electrode is normally operated at an electrical potential of lower value than the potential applied to the screen, the difference in these two potentials determining whether the operation of the tube is fundamentally post-deflection focusing or post-deflection acceleration. During operation of the tube, the scanning primary electron beams strike the solid structural portions of the color-selection electrode thereby effecting the generation of a cloud of secondary electrons in the vicinity of the color-selection electrode. Some of these low velocity secondary electrons are attracted through the large apertures or openings in the color-selection electrode by the higher screen potential, and as a result, randomly impinge the patterned screen. This resultant uncontrolled excitation of the color-emitting phosphors in the screen produces a spurious luminescent haze or background area brightness which markedly degrades the contrast of the screen display. In addition, the primary electron beams impacting the aluminum film on the back of the screen liberate more secondaries, in addition to some reflected primaries, which strike and excite adjacent phosphor areas thereby producing a halo-effect that degrades color purity and further aggravates the problem.

A number of attempts have been made in the art to control and minimize the effects of deleterious secondary emission in the tube. Such control endeavors have included, for example, the positioning of one or more related electrode structures in the proximity of the color-selection electrode; the employment of various configurations of shielding means; the application of carbonaceous or graphite coatings over the surfaces of both the color-selection electrode and the back of the screen; and the deposition of multiple layers of aluminum and other metals, such as boron and boron carbide, over the usual aluminum backing on the screen. In some instances, multi-layered depositions applied to the back of the screen, in thicknesses upwards of 7,000 angstroms, have manifest several drawbacks. Due to excessive thickness and the presence of interfacial surface contamination, multi-layer coatings have been prone to a degree of cracking and peeling in addition to the expensive and time-consuming procedures required for application. Broadly considered, exemplary corrective measures practiced in the art have resulted in varying degrees of success, but in general, most of the results have been less than desired.

OBJECTS AND SUMMARY OF THE INVENTION

It is an object of this invention to reduce and obviate the aforementioned disadvantages evidenced in the prior art. Another object of the invention is to provide an improved post-deflection type of color cathode ray tube and operational system to provide a high degree of contrast and improved color purity in the display imagery. A further object of the invention is to provide a post-deflection type of color cathode ray tube having improved means for controlling secondary electrons therein.

These and other objects and advantages are achieved in one aspect of the invention wherein improvement is achieved in a color cathode ray tube of the post-deflection acceleration type; such improvement being manifest by a system including related tube geometry. An exemplary tube in accordance with the invention, has electron generating means positioned within the envelope in a manner to direct a plurality of electron beams through a multi-apertured color-selection electrode to impinge discrete areas of a spatially related patterned cathodoluminescent screen having a metallic film disposed thereover. In accordance with the conjunctive system, the potential on the screen is in the order of substantially 20 to 40 kilovolts, while the potential of the related color-selection electrode is of a value more than substantially 72 percent and less than 85 percent of the screen potential thereby effecting a definitive voltage differential ($\Delta V$) therebetween. A definitive electron barrier is effected by the metallic aluminum film disposed on the back of the screen. This metallic film is of a specific thickness and provides a barrier for the secondary electrons prevalent in substantially the region between the screen and the color-selection electrode. This screen-backing aluminum film, in keeping with the aforementioned tube characteristics, has a thickness within the range of substantially 3,000 to 5,000 angstroms to provide a defined voltage penetration threshold that is directly relatable to the voltage differential ($\Delta V$), such voltage differential being substantially equal to or less than the voltage penetration threshold of the aluminum film. Thus, there is provided improved means, in the form of an operational system involving related tube geometry, for controlling the deleterious secondary electrons in the region of the screen thereby minimizing the background luminescence in the operational screen and markedly improving contrast and color purity of the image display evidenced thereon.

DESCRIPTION OF THE PREFERRED EMBODIMENT

For a better understanding of the present invention, together with other and further objects, advantages and capabilities thereof, reference is made to the following specification and appended claims in connection with the aforedescribed drawings.

In the display imagery of color cathode ray tubes, it is a prime desire to have the screen-reproduced image closely present the natural aspects of the original scene as televised. To achieve this result, it is necessary, in conjunction with color purity, to effect a proper relationship of both brightness and contrast; contrast being the degree of difference in tone between the lightest and the darkest areas in the scene. For example, monochrome pictures evidencing a high degree of contrast have deep blacks and brilliant whites, whereas scenes of low contrast have an over-all gray appearance. It has been noticed that screen images having high contrast luminance tend to beneficially evidence a greater perception of depth. This visual manifestation of depth is also augmented by vivid and crisp color renditions involving both color purity and contrast, factors which are directly relatable to the geometry of the tube and the operational characteristics thereof.

In color tubes of the post-deflection focusing type, (PDF) the potential applied to the color-selection grid is often of a value less than sixty percent that of the screen voltage. This difference of potentials provides significant focusing of the beams to smaller spot areas on the screen and produces a brightness advantage. But, under such operating conditions, there is a related loss of contrast in the display image because of the prevalence of uncontrolled secondary and reflected primary electrons which randomly impinge the screen. Additionally, in PDF type tubes there is usually a noticeable degradation of image resolution due to low gun potentials.

In contradistinction therewith, in a post-deflection acceleration (PDA) color cathode ray tube according to the invention, the color-selection electrode operates at a potential level that is substantially in the range of about 70 to 85 percent of the potential value applied to the screen. In this type of tube there is a beneficial tradeoff of a degree of brightness for desired contrast, discrete adjustment of which produces a marked improvement in the quality of the screen image. While the aspect of focusing in the PDA tube is somewhat reduced from that evidenced in a PDF tube, there are benefits manifest by this type of tube which are distinctly advantageous over the conventional shadow mask tube. These include: reduced deflection power requirements, less heating of the mask or color-selection electrode under electron bombardment, lower generation of x-rays, and reduced arcing in the gun structure. It is felt that the improvements set forth in this type of tube by this invention results in a significant enhancement in the quality of color cathode ray tube imagery.

Figure 1:
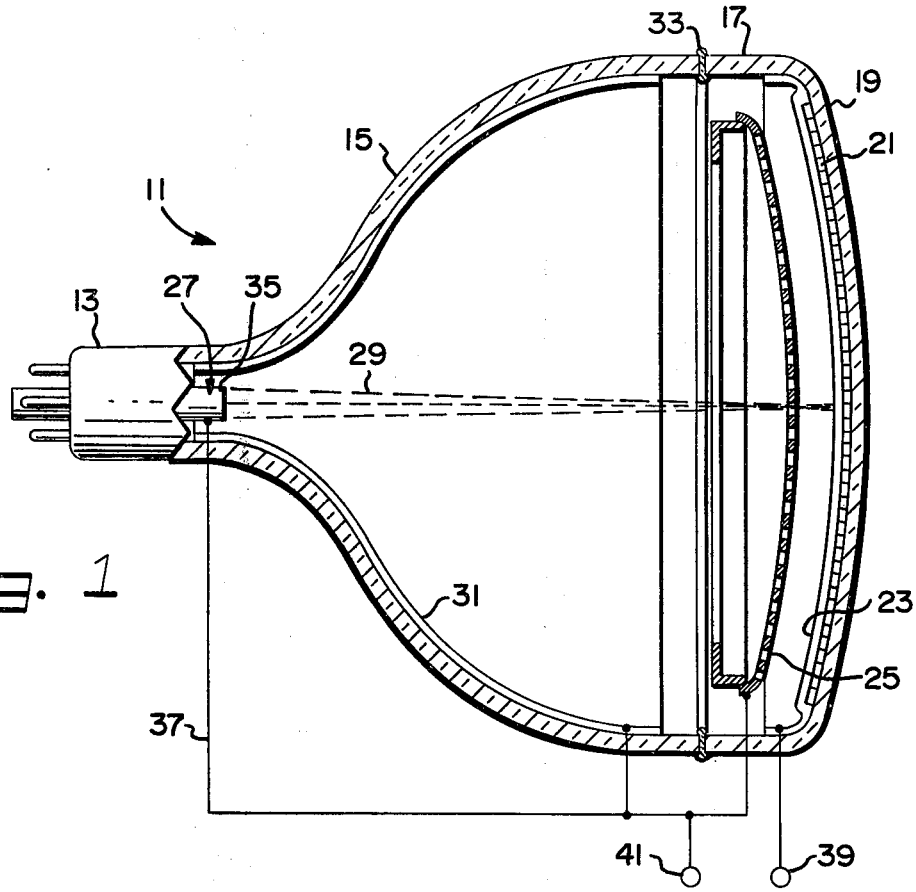
FIG. 1 is a cross-sectional view of a color cathode ray tube of the post-deflection acceleration type wherein the invention is illustrated.

Reference is directed to FIG. 1 wherein improvement in a post-deflection acceleration type of color cathode ray tube 11 is set forth in accordance with the invention. The tube is shown as having an envelope comprised of an integration of neck 13, funnel 15, and face panel 17 portions. Suitably disposed on the interior surface of the face panel, on the viewing portion 19 thereof, is a patterned cathodoluminescent screen 21 formed of discrete areas of a plurality of color-emitting phosphor materials definitively disposed as stripes or dots in keeping with the state of the art. A metallic film 23, of a material such as aluminum, is disposed over the surface of the screen. The presence of such a film is common in the art and fulfills a plurality of functions, such as, means for achieving electrical connection with the screen, means for dispersing electrical charge on the screen, and means for effecting forward reflectance of luminance emanating from the excited phosphors of the screen. In addition, according to an aspect of the invention, this film is formed to provide a definitive barrier to secondary electrons as will be later described.

Positioned within the face panel 17, and spatially related to the patterned screen 21 therein, is a discretely apertured structure 25, which in this instance, is referenced as a color-selection of mask electrode. The configuration of the apertures is in keeping with the desired pattern of the screen. Thus, such apertures may be substantially circular, ovate, or elongated in form. Electron generating means 27 are positioned within the neck portion 13 of the envelope in a manner to direct a plurality of electron beams 29 through the multi-apertured color-selection electrode member 25 to selectively impinge discrete areas of the patterned screen 21 therebeyond.

The funnel portion 15 has a skirt-like electrical conductive coating 31 disposed on the interior surface thereof; such coating extending substantially from the neck portion 13 to the forward region adjacent the sealing jointure 33 between the funnel 15 and the panel 17 portions. As shown, this funnel-disposed coating 31 is of the same potential as that applied to the terminal electrode 35 of electron generating means 27 and the color-selection electrode 25. Means for effecting the electrical connection between the terminal electrode 35 of the electron gun assembly, the funnel disposed coating 31, and the color selection electrode 25 are not explicitly shown but are conventional in the art and are usually oriented within the envelope. Schematic connective means 37 is shown to consummate the connection.

The metallic aluminum film 23 disposed over the screen and forming the definitive barrier to secondary electrons, is nominally of a uniform thickness within the range of substantially 3,000 to 5,000 angstroms, such being applicable as a single layer deposition. While such aluminum thickness has a minimal attenuation effect upon the primary electron beams passing therethrough, thickness within this range does beneficially provide a defined voltage penetration threshold that is directly relatable to the important voltage differential ($\Delta V$) existent between the color selection electrode potential and that of the screen. This voltage differential ($\Delta V$) is substantially equal to or less than the voltage penetration threshold of the aluminum film. Normally in the shadow mask type of tube, the thickness of the aluminum film is in the order of 2,000 to 2,500 angstroms.

According to the conjunctive operational system, the potential applied to the screen from an outside source through terminal 39 is within the range of substantially 25 to 40 kilovolts. A potential of somewhat lower value is applied to the color-selection electrode 25 from an outside source through terminal 41. This voltage is more than substantially 72 percent and less than substantially 85 percent of the applied screen voltage. The resultant voltage differential (ΔV) existent between the screen and the color-selection electrodes is realtable to a ratio within the range of substantially 1.2 to 1.4:1.0.

To achieve a desired degree of contrast in the screen image display and still maintain a beneficial focusing influence on each beam diameter, it has been found that the voltage differential (ΔV) should be greater than about 6 KV and less than about 8 KV. The focusing influence on the beam, relative to the size of the associated aperture, produces a dimensional constriction of each beam that effects a decrease in the diameter of the beam impingement area on the screen that is less than 0.001 of an inch smaller than would be manifest without the focusing influence. Since the openings in the color-selection electrode the related pattern configurations of the screen may be substantially circular, ovate or vertically elongated, the focusing dimensional constriction on the beam is broadly referenced in the direction of the beam scanning. The 6 to 8 KV range of voltage differential covers differential values that are substantially equal to or less than the voltage penetration threshold of obliteration voltage of the aforedescribed aluminum barrier film 23. Thus, the background luminescene of the screen, resultant from spurious impingement of secondary electrons thereon, is mimimized and the contrast and color purity of the screen display markedly improved.

Figure 2:
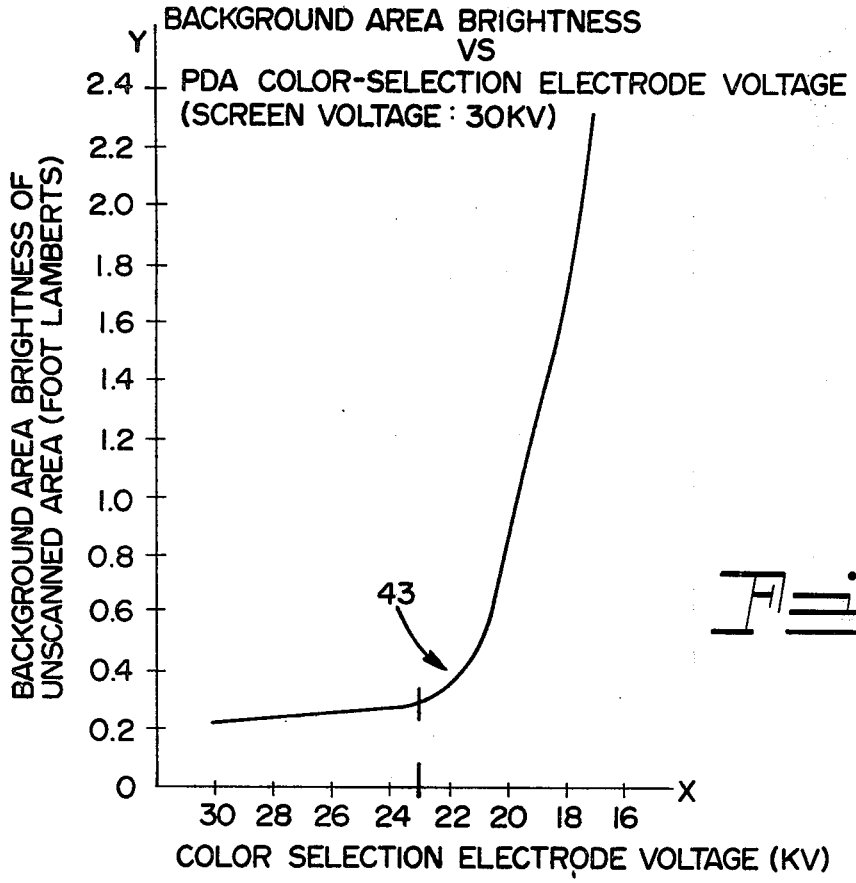
FIG. 2 is a graphical representation showing the relationship of the screen voltage and the color-selection electrode voltage relative to the background area brightness of the screen display.

Reference is directed to FIG. 2 wherein one example of the invention is graphically portrayed. The exemplary data charted therein is for a 19" 90° post-deflection acceleration type of color cathode ray tube 11 wherein the transmission of the glass color cathode ray tube 11 wherein the transmission of the glass viewing panel 19 is in the order of 85 percent. The patterned screen 21 is of dot-type structure upon which the aluminum barrier film 23, of substantially 4,400 angstroms thickness, is suitably disposed. The color-selection electrode 25 is formed to have substantially circular apertures whereof the diameters are in the order of substantially 0.0125 of an inch. The X-axis of the chart in FIG. 2 denotes a range of potentials applied to the color-selection electrode 25, and the Y-axis designates foot lambert values of the dark or background area brightness of the unscanned area of the screen. This evaluation of luminescence is obtained by positioning a raster image of reduced size in the central area of the viewing panel, whereupon, the dark or unscanned area thereabout is measured for brightness. The normal human eye does not noticeably detect the grayness of a black or dark area having an illumination of a value that is less than about 0.4 foot lamberts. The data presented by the curve 43 in FIG. 2 indicates that the exemplary tube 11 operating at a screen potential of 30 kilovolts, and a color-selection electrode voltage of 23 kilovolts, evidences a background area brightness in the order of 0.3 foot lamberts, such being a desirable level for good contrast. With further reference to the curve 43, it will be noted that the slope thereof rises rapidly as the color-selection electrode potential is decreased below substantially 22 kilovolts. Thus, the background area brightness of the unscanned area of the screen rapidly assumes a light gray tone thereby degrading contrast in the display. FIG. 2 shows that the definitive aluminum barrier covering the screen effectively absorbs the secondary electrons impinged thereon when the color-selection electrode potential is greater than about 22 kilovolts. Therefore, to achieve the desired degree of contrast of the screen and still utilize a beneficial degree of beam focusing, it is preferable to maintain the color-selection electrode potential within the range of about 22 to 24 kilovolts, hence a 6 to 8 KV differential (ΔV).

If desired, carbonaceous coatings known in the art may also be applied to the surface of the color-selection electrode and/or the screen and utilized conjunctively with the invention.

Thus, there is provided an improved system for a color cathode ray tube of the post-deflection acceleration type that minimizes the effect of secondary electron emission within the tube, improves color purity and achieves a high degree of contrast in the screen display imagery. Such are considered to be marked advancements in the art.

While there has been shown and described what are at present considered the preferred embodiments of the invention, it will be obvious to those skilled in the art that various changes and modifications may be made therein without departing from the scope of the invention as defined by the appended claims.

What is claimed is:

1. Improvement in a system relating to a color cathode ray tube of the post-deflection acceleration type, said tube having an envelope wherein an electron gun assembly is oriented to direct a plurality of scanning electron beams through a multi-apertured color-selection electrode member having a given potential supplied thereto from an external source to provide defined beam focusing upon discrete areas of a spatially related patterned cathodoluminescent screen having a metallic backing film disposed thereover, said screen having a higher potential applied thereto from a second external source thereby effecting a definitive voltage differential (ΔV) between said color-selection electrode and said screen, said system improvement comprising:

a screen potential within the range of substantially 20 to 40 kilovolts;

a color-selection electrode potential or more than substantially 72 percent and less than 85 percent of said screen voltage to effect said voltage differential (ΔV) therebetween, said color-selection electrode being substantially of the same potential as that of the terminal electrode of said electron gun assembly; and definitive electron barrier means effected within said tube by said backing film, said metallic film being of specific uniform thickness within the range of substantially 3,000 to 5,000 angstroms adheringly disposed as a single layer on the surface of said screen toward said color-selection electrode to provide a barrier for the secondary electrons prevalent in substantially the region between said screen and said color-selection electrode, the specific thickness of said barrier providing a defined voltage penetration threshold directly relatable to said voltage differential (ΔV), such (ΔV) being substantially equal to or less than the voltage penetration threshold of said film to provide improved contrast and color purity of the display and minimize background luminescence of the screen resultant from spurious impingement of secondary electrons thereon.

2. The system improvement relating to a post-deflection acceleration type of color cathode ray tube according to claim 1 wherein said voltage differential (ΔV) is greater than about 6 KV and less than about 8 KV.

3. The system improvement relating to a post-deflection acceleration type of color cathode ray tube according to claim 1 wherein said voltage differential (ΔV) is relatable to a ratio of said screen potential to said color-selection electrode potential within the range of 1.2 to 1.4:1.0.

* * * * *